US010580343B2

(12) United States Patent
Dai et al.

(10) Patent No.: US 10,580,343 B2
(45) Date of Patent: Mar. 3, 2020

(54) DISPLAY DATA TRANSMISSION METHOD AND APPARATUS, DISPLAY PANEL DRIVE METHOD AND APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Lei Dai, Beijing (CN); Taehyum Kim, Beijing (CN); Xiuzhu Tang, Beijing (CN)

(73) Assignees: BOE TECHNOLOGY GROUP CO., LTD., Beijing (CN); Chengdu BOE Optoelectronics Technology Co., Ltd., Chengdu (CN)

( * ) Notice: Subject to any disclaimer, the term of this patent is extended or adjusted under 35 U.S.C. 154(b) by 196 days.

(21) Appl. No.: 15/758,088

(22) PCT Filed: Jun. 26, 2015

(86) PCT No.: PCT/CN2015/082457
§ 371 (c)(1),
(2) Date: Mar. 7, 2018

(87) PCT Pub. No.: WO2016/095474
PCT Pub. Date: Jun. 23, 2016

(65) Prior Publication Data

US 2018/0254003 A1 Sep. 6, 2018

(30) Foreign Application Priority Data

Dec. 16, 2014 (CN) ..... 2014 1 0784633

(51) Int. Cl.
*G09G 3/20* (2006.01)
*G09G 5/00* (2006.01)

(52) U.S. Cl.
CPC ..... *G09G 3/2074* (2013.01); *G09G 3/2003* (2013.01); *G09G 5/003* (2013.01);
(Continued)

(58) Field of Classification Search
CPC ..... G09G 2330/021; G09G 2340/00; G09G 2340/02; G09G 3/2003; G09G 3/2074;
(Continued)

(56) References Cited

U.S. PATENT DOCUMENTS 6,326,980 B1 * 12/2001 Worley, III ..... G09G 3/2029 345/691
7,124,269 B2 * 10/2006 Chuang ..... G06F 9/30043 711/166
(Continued)

FOREIGN PATENT DOCUMENTS

CN 1573895 A 2/2005
CN 101030359 A 9/2007
(Continued)

OTHER PUBLICATIONS

International Search Report dated Jun. 26, 2015, issued in counterpart International Application No. PCT/CN2015/082457 (12 pages).
(Continued)

*Primary Examiner* — Richard J Hong
(74) *Attorney, Agent, or Firm* — Westerman, Hattori, Daniels & Adrian, LLP

(57) ABSTRACT

A display data transmission method and apparatus, and a display panel drive method and apparatus are provided. The display data transmission method is provided for transmitting display data to a display panel having a plurality of pixels. The display data transmission method comprises: calculating transmission data comprising an initial value and a plurality of sequential values, each value corresponding to a pixel of the plurality of pixels of the display panel; each of
(Continued)

the sequential values being a difference value between a gray scale value of the corresponding pixel and a gray scale value of an adjacent previous pixel; and transmitting the transmission data to the display panel.

16 Claims, 4 Drawing Sheets

(52) U.S. Cl.
CPC ... *G09G 2330/021* (2013.01); *G09G 2340/00* (2013.01); *G09G 2340/02* (2013.01)

(58) Field of Classification Search
CPC ..... G09G 5/003; G09G 3/2029; H04N 5/40; G06T 9/00; G06F 9/30043
See application file for complete search history.

(56) References Cited

U.S. PATENT DOCUMENTS

| | | | | |
|---|---|---|---|---|
| 2007/0200811 | A1 | 8/2007 | So | |
| 2008/0309603 | A1 | 12/2008 | Feng | |
| 2008/0317116 | A1* | 12/2008 | Lee | G06T 9/00 375/240.01 |
| 2009/0109210 | A1 | 4/2009 | Ito | |
| 2011/0080440 | A1 | 4/2011 | Cheon | |
| 2011/0249909 | A1 | 10/2011 | Lee et al. | |
| 2015/0009410 | A1* | 1/2015 | Ikushima | H04N 5/40 348/724 |

FOREIGN PATENT DOCUMENTS

| | | | |
|---|---|---|---|
| CN | 101325038 | A | 12/2008 |
| CN | 101547352 | A | 9/2009 |
| CN | 101645256 | A | 2/2010 |
| CN | 101833921 | A | 9/2010 |
| CN | 102097075 | A | 6/2011 |
| CN | 102984517 | A | 3/2013 |
| CN | 103065591 | A | 4/2013 |

OTHER PUBLICATIONS

Office Action dated Jul. 19, 2016, issued in counterpart Chinese Application No. 201410784633.6 (5 pages).

* cited by examiner

DISPLAY DATA TRANSMISSION METHOD AND APPARATUS, DISPLAY PANEL DRIVE METHOD AND APPARATUS

CROSS-REFERENCES TO RELATED APPLICATIONS

This PCT application claims the priority of Chinese Patent Application No. 201410784633.6, filed on Dec. 16, 2014, the entire contents of which are incorporated by reference herein.

FIELD OF THE INVENTION

The present invention generally relates to the field of display technologies and, more particularly, to a display data transmission method, a display data transmission apparatus, a display panel drive method and display panel drive apparatus.

BACKGROUND

With the increase of the size of the display panels of mobile devices, such as mobile phones, etc., how to reduce power consumption of the display panels has become a focus of attention. Especially when the definition of the display is increased, the amount of display data needs to be transmitted is correspondingly increased. Thus, the power consumption for display data transmission is also increased. The disclosed methods and apparatus are directed to at least partially alleviate one or more problems set forth above and other problems.

BRIEF SUMMARY OF THE DISCLOSURE

The purpose of the present disclosure includes providing a display data transmission method, a display data transmission apparatus, a display panel drive method, and a display apparatus so as to reduce the size of the data transmission; and lower the power consumption.

In order to solve the above mentioned technical issues, one aspect of the present disclosure includes providing a display data transmission method for transmitting display data to a display panel having a plurality of pixels. The display data transmission method includes calculating transmission data comprising an initial value and a plurality of sequential values, each value corresponding to a pixel of the plurality of pixels of the display panel; each of the sequential values being a difference value between a gray scale value of the corresponding pixel and a gray scale value of an adjacent previous pixel; and transmitting the transmission data to the display panel.

Optionally, the initial value corresponds to a difference value between a gray scale value of a first pixel of the display panel and a pre-set gray scale value.

Optionally, the pre-set gray scale value is a medium value of all gray scale values of the display panel; the gray scale of the display panel includes 256 gray scale values from 0 to 255; and the pre-set gray scale value is 128.

Optionally, each pixel includes three subpixels; and the three subpixels are a red subpixel, a green subpixel and a blue subpixel.

Optionally, the difference value between the gray scale value and the pre-set gray scale value of the first pixel is calculated by calculating a difference value between a gray scale value of the red subpixel of the first pixel and a pre-set gray scale value to be used as transmission data of the red subpixel of the first pixel; calculating a difference value between a gray scale value of the green subpixel of the first pixel and a pre-set gray scale value to be used as transmission data of the green subpixel of the first pixel; and calculating a difference value between a gray scale value of the blue subpixel of the first pixel and a pre-set gray scale value to be used as transmission data of the blue subpixel of the first pixel.

Optionally, the difference value between the gray scale value of the corresponding pixel and the gray scale value of an adjacent previous pixel is calculated by: calculating a difference value between a gray scale value of the red subpixel of the corresponding pixel and a gray scale value of the red subpixel of an adjacent previous pixel to be used as transmission data of the red subpixel of the corresponding pixel; calculating a difference value between a gray scale value of the green subpixel of the corresponding pixel and a gray scale value of the green subpixel of an adjacent previous pixel to be used as transmission data of the green subpixel of the corresponding pixel; and calculating a difference value between a gray scale value of the blue subpixel of the corresponding pixel and a gray scale value of the blue subpixel of an adjacent previous pixel to be used as transmission data of the blue subpixel of the corresponding pixel.

Optionally, the transmission data is represented by binary numbers.

Optionally, before transmitting the obtained transmission data of each pixel to the display panel, the display data transmission method further includes compressing a number of binary digits occupied by the transmission data according to a certain size of the transmission data.

Optionally, each pixel includes three subpixels; the binary bits occupied by the transmission data of each subpixel include a direction flag; and the direction flag is disposed at the first bit of the transmission data.

Optionally, for each subpixel of the first pixel, when an actual gray value is greater than or equal to a pre-set gray scale value, the direction flag is set as 1; and when the actual gray value is smaller than a pre-set gray scale value, the direction flag is set as 0.

Optionally, for each subpixel of the pixels staring from the second pixel to the last pixel of the display panel, when an actual gray value is greater than or equal to a gray scale value of the corresponding subpixel of an adjacent previous pixel, the direction flag is set as 1; and when the actual gray value is smaller than a gray scale value of the corresponding subpixel of an adjacent previous pixel, the direction flag is set as 0.

Optionally, the transmission data of each pixel includes transmission data of the three subpixels and a length flag used to label number of binary bits occupied by each subpixel; and the length flag is disposed as the first bit of the transmission data.

Optionally, when the number of the binary bits occupied by the transmission data of each subpixel is 8, the length flag is set as 1; and when the number of the binary bits occupied by the transmission data of each subpixel is greater than 2 and smaller than 8, the length flag is set as 0.

Another aspect of the present disclosure includes a display panel drive method for driving a display panel having a plurality of pixels. The display panel drive method includes the disclosed display data transmission method and a display data restore method.

Optionally, the display data restore method further includes adding the initial value with the pre-set gray scale value to obtain a restored gray scale value of the first pixel; adding each of the sequential values of the corresponding pixel to a gray scale value of an adjacent previous pixel to obtain a restored gray scale value of corresponding pixel; and driving the display panel to display the pixels according to the restored gray scale values.

Another aspect of the present disclosure includes a display data transmission apparatus configured to transmit display data to a display panel. The apparatus includes a calculating unit and a transmission unit. The calculating unit is configured to calculate transmission data comprising an initial value and a plurality of sequential values, each value corresponding to a pixel of the plurality of pixels of the display panel; each of the sequential values being a difference value between a gray scale value of the corresponding pixel and a gray scale value of an adjacent previous pixel. The transmission unit is configured to transmit the transmission data of each pixel obtained by the calculating unit to the display panel.

Optionally, the display data transmission apparatus further includes a data processing unit configured to compress a number of binary bits occupied by the transmission data according to a size of the transmission data, and to transmit the compressed data to the transmission unit.

Another aspect of the present disclosure includes a display panel drive apparatus. The display drive apparatus includes the disclosed display data transmission apparatus; and a display data restore apparatus configured to restore transmission data of each pixel to a restored gray scale value.

Optionally, the data restore apparatus further includes a data restore unit configured to add the initial value with the pre-set gray scale value to obtain a restored gray scale value of the first pixel and to add each of the sequential values of the corresponding pixel to a gray scale value of an adjacent previous pixel to obtain a restored gray scale value of corresponding pixel; and a display drive unit configured to drive the display panel to display the pixels according to the restored gray scale value of each pixel obtained by the data restore unit.

Other aspects of the present disclosure can be understood by those skilled in the art in light of the description, the claims, and the drawings of the present disclosure.

DETAILED DESCRIPTION

Reference will now be made in details to exemplary embodiments of the invention, which are illustrated in the accompanying drawings.

According to the present disclosure, for an image displayed on a display panel of a mobile device, the gray scale values (display data) of adjacent pixels of the image may not have significant differences. In order to cause the image to appear softer and more uniform, the pixels having abrupt color change may need to be treated as more saturate. The difference of the display data, i.e., the gray scale values, of the adjacent pixels of the image may be further reduced. For the display panel of a cell phone, the user interface (UI) may include a background image and ICONs. The background image and the ICONs may often designed as a same color theme. Thus, the display data of the adjacent pixels may also not have significant differences.

That is, the difference of the display data between the adjacent pixels may be much smaller than the actual display data of these pixels. If the difference is used for the display data transmission, the data size of the display data transmission may be reduced, and the power consumption for the data transmission may also be reduced.

Figure 1:
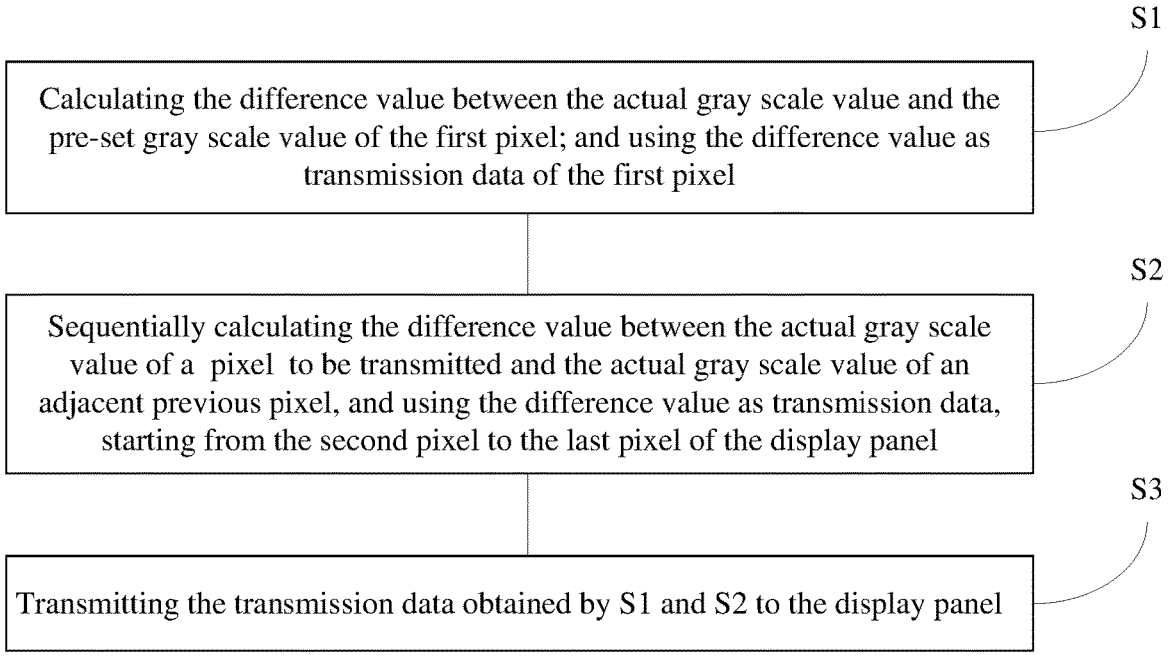
FIG. 1 illustrates an exemplary display data transmission method according to the disclosed embodiments.

FIG. 1 illustrates an exemplary display data transmission method according to the disclosed embodiments. The display data transmission method may be used to transmit display data to a display panel. The display panel may have a plurality of pixels and each pixel may have a gray scale value when displaying image data.

As shown in FIG. 1, the display data transmission method may include following steps.

Step S1: calculating a difference value between the actual gray scale value and the pre-set gray scale value of a first pixel; and using the difference value as the transmission data of the first pixel.

Step S2: starting from the second pixel, sequentially calculating the difference value between the actual gray scale value of a pixel to be transmitted and the actual gray scale value of an adjacent previous pixel, and using the difference value as transmission data for that pixel. For example, the difference value between the actual gray value of the second pixel and the actual gray value of the first pixel is used as the transmission data of the second pixel; and the difference value between the actual gray value of the third pixel and the gray scale value of the second pixel may be used as the transmission data of the third pixel. The calculating process may be repeated until the transmission data of each pixel of the display panel is obtained.

That is, the calculated transmission data includes an initial value and a plurality of sequential values, with each value corresponding to a pixel of the plurality of pixels of the display panel. Each of the sequential values is a difference value between a gray scale value of the corresponding pixel and a gray scale value of an adjacent previous pixel. The initial value corresponds to a gray scale value of a first pixel and, more specifically, corresponds to a difference value between a gray scale value of a first pixel of the display panel and a pre-set gray scale value.

Step S3: transmitting the transmission data obtained by Step S1 and Step S2 to the display panel. The transmission data may include the difference value between the actual gray scale value and the pre-set gray scale value of the first pixel; and the difference value between the actual gray scale value of a next pixel to be transmitted and the actual gray scale value of its adjacent previous pixel, starting from the second pixel to the last pixel of the display panel.

Additionally or alternatively, the pixels may be separated into a plurality of groups, with each group having certain number of pixels. Step S3 can then be applied on individual groups, one group at a time, until all groups are transmitted.

Thus, the disclosed data transmission method uses the difference values of the gray scale values of adjacent pixels to substitute the actual gray scale value of each pixel, and the data size of the display data transmission may be reduced. The electrical current consumption for the display data transmission may also be reduced; and the power consumption of the display panel may be reduced.

For the first pixel, the pre-set gray scale value may by any gray scale value of the pixels of the display panel. However, for different displayed images, the gray scale value of the first pixels may be different. In order to make the difference value between the actual gray scale value of the first pixel and the pre-set gray scale value of the first pixel to be as small as possible, the pre-set gray scale value of the first pixel may be the medium value of all the gray scale values of the display panel.

For example, when the display panel has 256 gray scales ranging from 0 to 255, the medium value is 128. Thus, the pre-set gray scale value of the first pixel may be 128. Other values may also be used.

Figure 6:
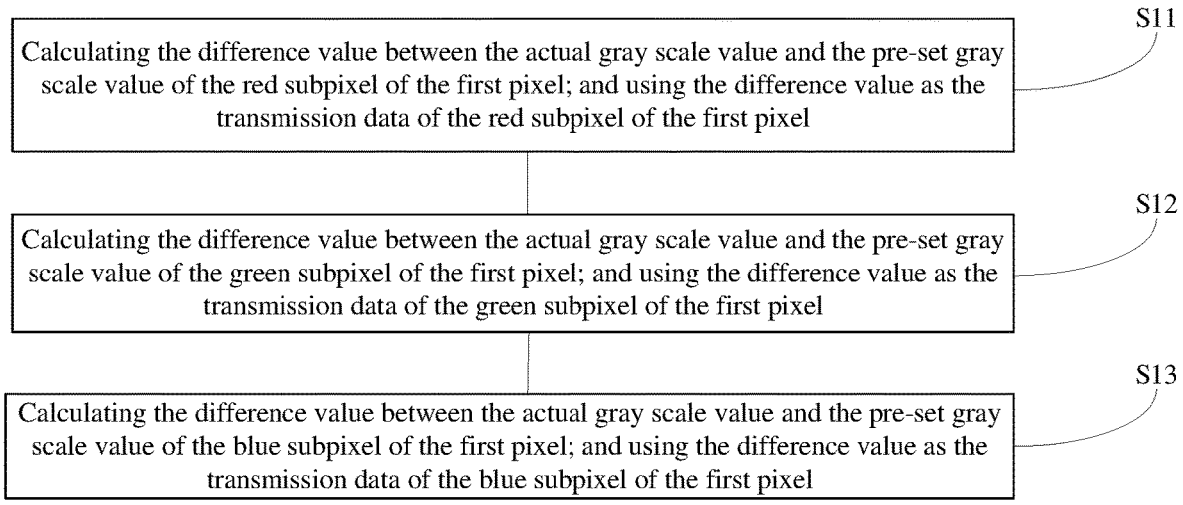
FIG. 6 illustrates a certain step of the exemplary display data transmission method according to the disclosed embodiments.

For color display, each pixel of the display panel may include three subpixels. The three subpixels may be a red subpixel, a green subpixel, and a blue subpixel (RGB). Other subpixels may also be used. For example, each pixel may include four or five subpixels, such as a red subpixel, a green subpixel, a blue subpixel, and a white subpixel (RGBW), or a red subpixel, a green subpixel, a blue subpixel, a yellow subpixel, and a white subpixel (RGBYW). Thus, when RGB subpixels are used, as shown in FIG. 6 the Step S1 of the display date transmission method may include the following steps.

Step S11: calculating the difference value between the actual gray scale value and the pre-set gray scale value of the red subpixel of the first pixel; and using the difference value as the transmission data of the red subpixel of the first pixel.

Step S12: calculating the difference value between the actual gray scale value and the pre-set gray scale value of the green subpixel of the first pixel; and using the difference value as the transmission data of the green subpixel of the first pixel.

Step S13: calculating the difference value between the actual gray scale value and the pre-set gray scale value of the blue subpixel of the first pixel; and using the difference value as the transmission data of the blue subpixel of the first pixel.

Figure 7:
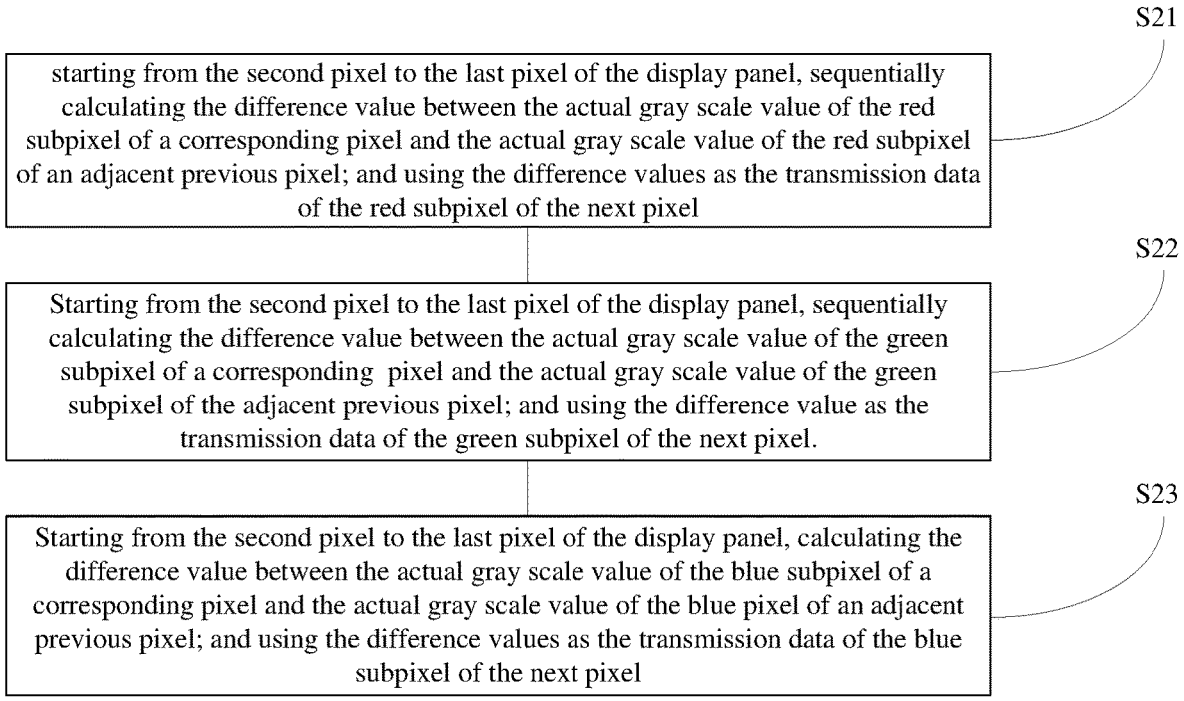
FIG. 7 illustrates another certain step of the exemplary display data transmission method according to the disclosed embodiments.

Correspondingly, as shown in FIG. 7, the Step S2 of the display data transmission method may further include the following steps.

Step S21: starting from the second pixel to the last pixel of the display panel, sequentially calculating the difference value between the actual gray scale value of the red subpixel of a corresponding pixel (i.e. a next pixel to be transmitted) and the actual gray scale value of the red subpixel of an adjacent previous pixel; and using the difference values as the transmission data of the red subpixel of the next pixel.

Step S22: starting from the second pixel to the last pixel of the display panel, sequentially calculating the difference value between the actual gray scale value of the green subpixel of a corresponding pixel and the actual gray scale value of the green subpixel of the adjacent previous pixel; and using the difference value as the transmission data of the green subpixel of the next pixel.

Step S23: starting from the second pixel to the last pixel of the display panel, calculating the difference value between the actual gray scale value of the blue subpixel of a corresponding pixel and the actual gray scale value of the blue pixel of an adjacent previous pixel; and using the difference values as the transmission data of the blue subpixel of the next pixel.

In one embodiment, the transmission data may be represented by binary numbers. When the difference values of the gray scale values between adjacent pixels are used to substitute the actual gray scale values to transmit display data, the value of the transmission data may become smaller. Thus, the transmission data may be compressed. That is, the number of binary digits or bits occupied by the transmission data of the pixels may be reduced or shrunk. Thus, the electrical current consumption for the data transmission may be reduced; and the power consumption of the display panel may be reduced.

Therefore, before the Step S3 of the display data transmission method, the following steps may also be included.

Step S30: compressing or shrinking the binary digits or bits according to the size of the transmission data to reduce the electrical current consumption for the display data transmission; and to reduce the power consumption of the display panel.

Specifically, because each pixel may include three subpixels, in order to label the difference values between each of the subpixels and the subpixels of the adjacent previous pixel, such as increase, or decrease, it may need to set an increase/decrease (+/−) flag bit in the transmission data in each of the subpixels. Thus, the binary transmissions data of each subpixel may include the (+/−) flag bit; and the (+/−) flag bit may be disposed at the first bit of the transmission data of each subpixel.

For the subpixels of the first pixel, when the actual gray scale value is equal to, or greater than the pre-set gray scale value, the (+/−) flag bit is 1, i.e., increase. When the actual gray scale value smaller than the pre-set gray scale value, the (+/−) flag bit is 0, i.e., decrease.

Starting from the second pixel, when the gray scale value of the subpixel is greater or equal to the corresponding subpixel of the adjacent previous pixel, the (+/−) flag bit is 1, i.e., increase. When the gray scale value of the subpixel is smaller than the corresponding subpixel of the adjacent previous pixel, the (+/−) flag bit is 0, i.e., decrease.

To simplify the description, this increase/decrease (+/−) flag bit may also be referred as a direction flag, i.e., indicating a direction for increasing or decreasing.

Further, for the transmission data of each pixel, it may not only include the transmission data of the three subpixels of the pixel, but also include a data length flag bit used to present the number of binary digits or bits occupied by each of the subpixels. Further, the data length flag bit may be located at the beginning of the transmission data of the corresponding pixel.

For example, when the number of binary bits occupied by the transmission data of each subpixel of a pixel is 8, the data length flag bit may be set as 1. When the number of binary bits occupied by the transmission data of the subpixels of the pixel is greater than 2 and smaller than 8, the data length flag bit may be set as 0.

To simplify the description, this data length flag bit may also be referred as a length flag, i.e., indicating a length of the transmission data of each subpixel of the pixel. When the length flag is 1, full data length (e.g., 8 bits) may be used for the transmission data; when the length flag is 0, partial data length (e.g., 3, 4, or 5 bits) may be used for the transmission data. Further, when the length flag is 0, the actual number of bits occupied by the transmission data of the subpixels of the pixel may be determined based on the size of the transmission data, the type of the transmission data, and/or the type of the image to be displayed using the transmitted data. For example, one image type may use 5 bits for the transmission data, while another image type may use 4 bits for the transmission data.

Thus, in one embodiment, the number of the binary bits occupied by each subpixel to transmit data may be identified by the length flag, and the data difference between the transmitted data of each subpixel, such as positive number, negative number, or zero, may be identified by the direction flag. The details of the present disclosure may be further explained in the following examples.

Table 1.1 illustrates the actual gray scale value of a first pixel, a second pixel, and a third pixel of a display panel, and the corresponding difference values. The difference value of the first pixel is the difference between the actual gray scale of the first pixel and the medium value of 128. The difference value of the second pixel is the difference between the actual gray value of the second pixel and the actual gray value of the first pixel. The difference value of the third pixel is the difference between the actual gray scale value of the third pixel and the actual gray scale value of the second pixel. Further, each of the first pixel, the second pixel, and the third pixel includes R, G, and B subpixels (red, green, and blue subpixels), and the gray scale value of each subpixel is given by binary digits and decimal value.

second pixel and the transmission data of each subpixel of the third pixel may be compressed; and the number of occupied binary bits for each subpixel of the second pixel and the third pixel is 5; and the length flag is 0. The 5 bits may be determined based on the size of the transmission data or may be determined based on the image type, or both.

Thus, as shown in Table 1.2, the transmission data of the second pixel and the transmission data of the third pixel are compressed from 8 bits to 5 bits; and the data length may be reduced 31%. Therefore, the transmitted data size may be reduced; and the power consumption of the display panel may be reduced.

Table 2.1 illustrates the actual gray scale values of a first pixel, a second pixel and a third pixel of a display panel, and corresponding difference values. As shown in Table 2.1 the actual gray scale value of the first pixel, the actual gray scale value of the second pixel, and the actual gray scale value of the third pixel are identical.

TABLE 1.1

| | First pixel | | | | | | | | | | | | | | | | | | | | | | | |
|---|---|---|---|---|---|---|---|---|---|---|---|---|---|---|---|---|---|---|---|---|---|---|---|---|
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 1 | 1 | 1 | 1 | 0 | 0 | 1 | 0 | 1 | 1 | 0 | 1 | 1 | 0 | 1 | 0 | 1 | 1 | 1 | 0 | 0 | 1 |
| Decimal value | | | | 124 | | | | | | | | 182 | | | | | | | | 185 | | | | |
| Difference value | | | | −4 | | | | | | | | 54 | | | | | | | | 57 | | | | |
| | Second pixel | | | | | | | | | | | | | | | | | | | | | | | |
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 1 | 1 | 0 | 0 | 0 | 0 | 1 | 0 | 1 | 0 | 1 | 0 | 0 | 0 | 1 | 0 | 1 | 0 | 1 | 1 | 1 | 1 |
| Decimal value | | | | 112 | | | | | | | | 168 | | | | | | | | 175 | | | | |
| Difference value | | | | −12 | | | | | | | | −14 | | | | | | | | −10 | | | | |
| | Third pixel | | | | | | | | | | | | | | | | | | | | | | | |
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 1 | 1 | 0 | 1 | 1 | 0 | 1 | 0 | 1 | 1 | 0 | 0 | 0 | 1 | 1 | 0 | 1 | 1 | 0 | 1 | 1 | 0 |
| Decimal value | | | | 118 | | | | | | | | 177 | | | | | | | | 182 | | | | |
| Difference value | | | | 6 | | | | | | | | 9 | | | | | | | | 7 | | | | |

Table 1.2 illustrates the transmission data of the first pixel, the second pixel and the third pixel illustrated in Table 1.1. F1 refers to the length flag; and F2 refers to the direction flag.

The difference value of the first pixel is the difference between the actual gray scale value and the medium value 128. The difference value of the second pixel is the difference between the actual gray scale value of the second pixel

TABLE 1.2

| First Pixel | | | | | | | | | | | | | | | | | | | | | | | | |
|---|---|---|---|---|---|---|---|---|---|---|---|---|---|---|---|---|---|---|---|---|---|---|---|---|
| F1 | F2 | R6 | R5 | R4 | R3 | R2 | R1 | R0 | F2 | G6 | G5 | G4 | G3 | G2 | G1 | G0 | F2 | B6 | B5 | B4 | B3 | B2 | B1 | B0 |
| 1 | 0 | 0 | 0 | 0 | 0 | 1 | 0 | 0 | 1 | 0 | 1 | 1 | 0 | 1 | 1 | 0 | 1 | 0 | 1 | 1 | 1 | 0 | 0 | 1 |
| Second pixel | | | | | | | | | | | | | | | | | | | | | | | | |
| | F1 | F2 | R3 | R2 | R1 | R0 | F2 | G3 | G2 | G1 | G0 | F2 | B3 | B2 | B1 | B0 | | | | | | | | |
| | 0 | 0 | 1 | 1 | 0 | 0 | 0 | 1 | 1 | 1 | 0 | 0 | 1 | 0 | 1 | 0 | | | | | | | | |
| Third pixel | | | | | | | | | | | | | | | | | | | | | | | | |
| | F1 | F2 | R3 | R2 | R1 | R0 | F2 | G3 | G2 | G1 | G0 | F2 | B3 | B2 | B1 | B0 | | | | | | | | |
| | 0 | 1 | 0 | 1 | 1 | 0 | 1 | 1 | 0 | 0 | 1 | 1 | 0 | 1 | 1 | 1 | | | | | | | | |

As shown in Table 1.2, the transmission data of each subpixel of the first pixel may occupy 8 binary bits; and the length flag is 1. The transmission data of each subpixel of the and the actual gray scale value of the first pixel. The difference value of the third pixel is the difference between the actual gray scale value of the third pixel and the actual gray scale value of the second pixel. Further, each of the first pixel, the second pixel, and the third pixel includes R, G, and B subpixels, and the gray scale value of each pixel is given by binary digits and decimal values.

TABLE 2.1

| | First pixel | | | | | | | | | | | | | | | | | | | | | | | |
|---|---|---|---|---|---|---|---|---|---|---|---|---|---|---|---|---|---|---|---|---|---|---|---|---|
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 0 | 1 | 1 | 1 | 0 | 1 | 0 | 0 | 0 | 0 | 0 | 1 | 0 | 0 | 1 | 1 | 0 | 1 | 1 | 0 | 0 | 1 |
| Decimal value | | | | | 93 | | | | | | | | 4 | | | | | | | | 217 | | | |
| Difference value | | | | | −35 | | | | | | | | −124 | | | | | | | | 89 | | | |
| | Second pixel | | | | | | | | | | | | | | | | | | | | | | | |
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 0 | 1 | 1 | 1 | 0 | 1 | 0 | 0 | 0 | 0 | 0 | 1 | 0 | 0 | 1 | 1 | 0 | 1 | 1 | 0 | 0 | 1 |
| Decimal value | | | | | 93 | | | | | | | | 4 | | | | | | | | 217 | | | |
| Difference value | | | | | 0 | | | | | | | | 0 | | | | | | | | 0 | | | |
| | Third pixel | | | | | | | | | | | | | | | | | | | | | | | |
| RGB | R7 | R6 | R5 | R4 | R3 | R2 | R1 | R0 | G7 | G6 | G5 | G4 | G3 | G2 | G1 | G0 | B7 | B6 | B5 | B4 | B3 | B2 | B1 | B0 |
| Binary digits | 0 | 1 | 0 | 1 | 1 | 1 | 0 | 1 | 0 | 0 | 0 | 0 | 0 | 1 | 0 | 0 | 1 | 1 | 0 | 1 | 1 | 0 | 0 | 1 |
| Decimal value | | | | | 93 | | | | | | | | 4 | | | | | | | | 217 | | | |
| Difference value | | | | | 0 | | | | | | | | 0 | | | | | | | | 0 | | | |

Table 2.2 illustrates the transmission data of the first pixel, the second pixel and the third pixel illustrated in Table 2.1. In Table 2.2, F1 refers to the length flag; and F2 refers to the direction flag.

TABLE 2.2

| First pixel | | | | | | | | | | | | | | | | | | | | | | | | |
|---|---|---|---|---|---|---|---|---|---|---|---|---|---|---|---|---|---|---|---|---|---|---|---|---|
| F1 | F2 | R6 | R5 | R4 | R3 | R2 | R1 | R0 | F2 | G6 | G5 | G4 | G3 | G2 | G1 | G0 | F2 | B6 | B5 | B4 | B3 | B2 | B1 | B0 |
| 1 | 0 | 0 | 1 | 0 | 0 | 0 | 1 | 1 | 0 | 1 | 1 | 1 | 1 | 1 | 0 | 0 | 1 | 1 | 0 | 1 | 1 | 0 | 0 | 1 |
| Second pixel | | | | | | | | | | | | | | | | | | | | | | | | |
| F1 | | F2 | | R2 | | R1 | | R0 | | F2 | | G2 | | G1 | | G0 | | F2 | | B2 | | B1 | | B0 |
| 0 | | 1 | | 0 | | 0 | | 0 | | 1 | | 0 | | 0 | | 0 | | 1 | | 0 | | 0 | | 0 |
| Third pixel | | | | | | | | | | | | | | | | | | | | | | | | |
| F1 | | F2 | | R2 | | R1 | | R0 | | F2 | | G2 | | G1 | | G0 | | F2 | | B2 | | B1 | | B0 |
| 0 | | 1 | | 0 | | 0 | | 0 | | 1 | | 0 | | 0 | | 0 | | 1 | | 0 | | 0 | | 0 |

Further, as shown in Table 2.2, the transmission data of each subpixel of the first pixel occupies 8 binary bits; and the length flag is set as 1. The transmission data of each subpixel of the second pixel and the third pixel may be compressed. Thus, 4 binary digits are occupied; and the length flag is set as 0. Thus, when the transmission data is compressed from 8 bits to 4 bits, the data length may be reduced 43%. The transferred data size may be effectively reduced; and the power consumption of the display panel may be reduced.

Figure 2:
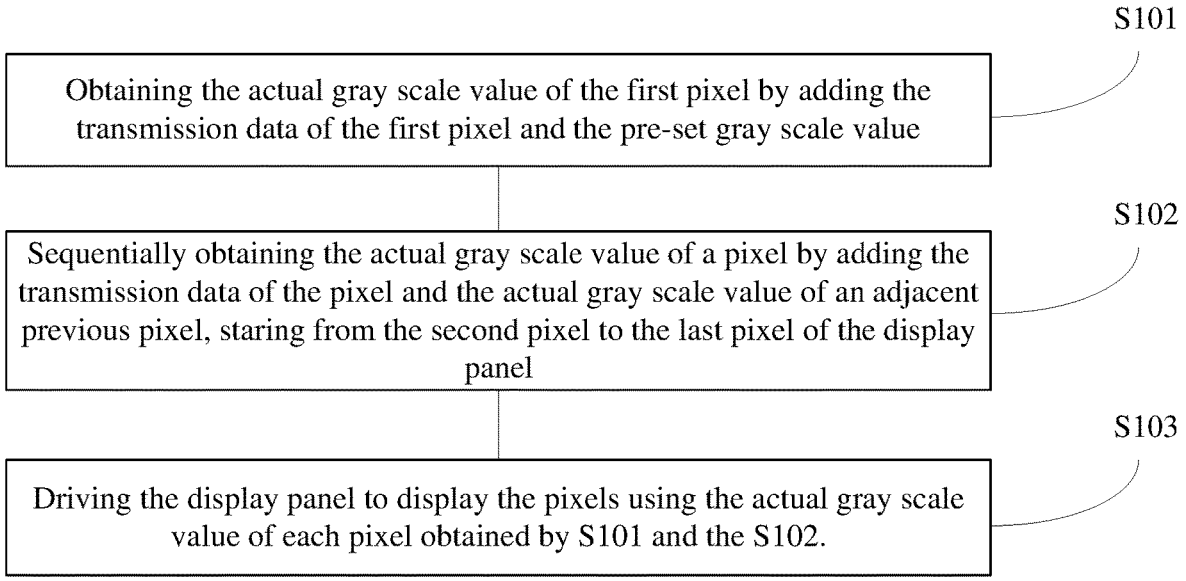
FIG. 2 illustrates an exemplary display data restore method of an exemplary display data drive method according to the disclosed embodiments.

Further, a display panel drive method may be provided by the disclosed embodiments. The display panel drive method may include the display data transmission method described above; and a display data restore method. FIG. 2 illustrates an exemplary display data restore method.

As shown in FIG. 2, the display data restore method may include the following steps.

Step S101: obtaining the actual gray scale value of the first pixel by adding the transmission data of the first pixel and the pre-set gray scale value.

Step S102: starting from the second pixel to the last pixel of the display panel sequentially obtaining the actual gray scale value of a corresponding pixel by adding the transmission data of the pixel and the actual gray scale value of an adjacent previous pixel.

For example, the length flag may be obtained first to determine data length of the transmission data for the pixel/subpixels. For partial data length, actual number of binary bits representing the transmission data may be determined based on, for example, an image type or other predetermined information. Further, the direction flag may be obtained to determine the direction of operation, decreasing or increasing.

Step S103: driving the display panel to display the pixels using the actual gray scale value of each pixel obtained by S101 and the S102.

By using such a display data restore method, the transmitted data may be sequentially stored and combined, starting from the first pixel to the last pixel of the display panel, to restore the actual gray scale value of each subpixel. Thus, the image may be accurately displayed.

Figure 3:
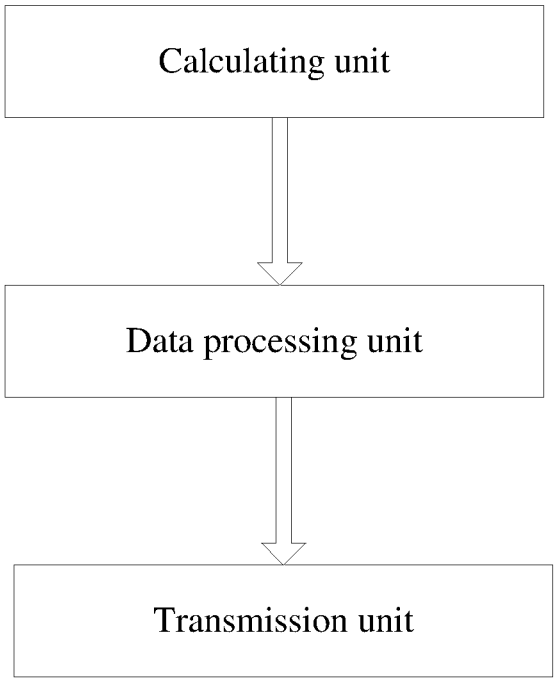
FIG. 3 illustrates an exemplary display data transmission apparatus according to the disclosed embodiments.

FIG. 3 illustrates an exemplary display data transmission apparatus according to the disclosed embodiments. The display data transmission apparatus may be used to transmit display data to the display panel. The display panel may include a plurality of pixels.

As shown in FIG. 3, the display data transmission apparatus may include a calculating unit. The calculating unit may be used to calculate the difference value between the actual gray scale value and the pre-set gray scale value of the first pixel. The difference value may be used as the transmission data of the first pixel. Further, starting from the second pixel to the last pixel of the display panel, the calculating unit may also be used to sequentially calculate the difference value between the actual gray scale value of a corresponding pixel and the actual gray scale value of an adjacent previous pixel. The obtained difference values may be used as the transmission data of the corresponding (i.e. the next pixel to be transmitted) pixel.

Further, the display data transmission apparatus may also include a transmission unit. The transmission unit may be used to transmit the difference value of each pixel obtained by the calculating unit to the display panel.

Thus, by using the difference values of the gray scale values of adjacent pixels, the transmitted data size may be reduced. Thus, the electrical current consumption for the display data transmission may be reduced; and the power consumption of the display panel may be reduced.

Optionally, the display data transmission apparatus may also include a data processing unit. The data processing unit may be used to compress the binary digits or bits occupied by the transmission data according to the size of the transmission data; and transmit the compressed transmission data to the transmission unit.

As described previously, the transmission data may be represented by binary numbers. When the difference values of the gray scale value of the adjacent pixels are used to substitute the actual gray scale values to transmit data, because the values of the transferred data are reduced, the transmission data may be compressed. That is, the binary digits or bits occupied by the transmitted pixels may be reduced. Thus, the electrical current consumption of the display data transmission process may be reduced; and the power consumption of the display panel may be reduced.

Further, the present disclosure also includes providing a display panel drive apparatus. The display panel drive apparatus may include a transmission apparatus described previously; and a data restore apparatus. The data restore apparatus may be used to restore the transmission data of each pixel to the actual gray scale value.

Figure 4:
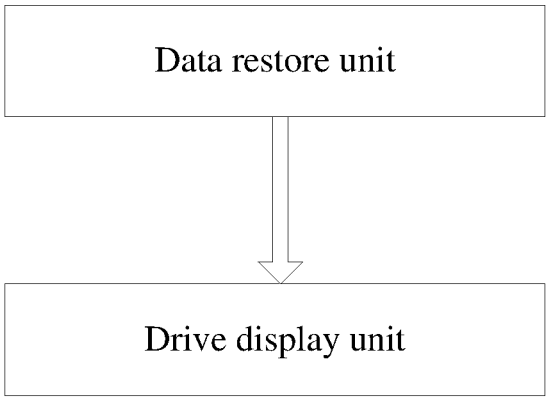
FIG. 4 illustrates an exemplary data restore apparatus of a display drive apparatus according to the disclosed embodiments.

As shown in FIG. 4, the data restore apparatus may include a data restore unit. The data restore unit may be used to add the transmission data of the first pixel with the pre-set gray scale value to obtain the actual gray scale value of the first pixel. Further, starting from the second pixel to the last pixel of the display panel, the restore apparatus may be used to sequentially add the transmission data of a corresponding pixel with the actual gray scale value of an adjacent previous pixel to obtain the actual gray scale value of the corresponding pixel.

Further, the data restore apparatus may also include a display drive unit. The display drive unit may be used to drive the display panel to display the pixels according to the actual gray scale value of each pixel obtained by the data restore unit.

By using the data restore unit, starting from the first pixel to the last pixel of the display panel, the transmission data may be sequentially added to restore the actual gray scale value of each pixel. Thus, the pixels may be accurately displayed.

Figure 5:
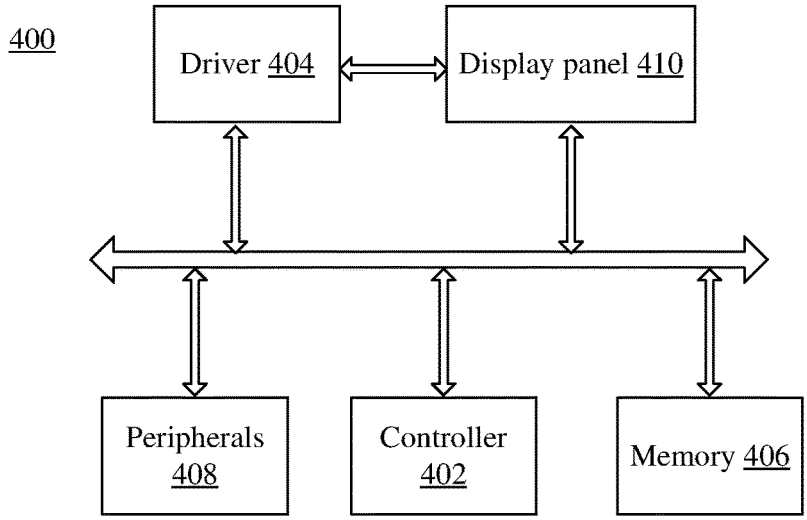
FIG. 5 illustrates an exemplary display apparatus according to the disclosed embodiments.

Further, the present disclosure also includes a display apparatus. FIG. 5 illustrates an exemplary display apparatus 400 incorporating the disclosed display data transmission apparatus, display panel drive apparatus, and other aspects of the present disclosure.

The display apparatus 400 may be any appropriate device or component with certain display function, such as a display, a TV, a monitor, a cell phone or smartphone, a computer, a notebook computer, a tablet, a digital photo-frame, or a navigation system, etc. As shown in FIG. 5, the display apparatus 400 includes a controller 402, a driver circuit 404, a memory 406, peripherals 408, and a display panel 410. Certain devices may be omitted and other devices may be included.

The controller 402 may include any appropriate processor or processors, such as a general-purpose microprocessor, digital signal processor, and/or graphic processor. Further, the controller 402 can include multiple cores for multi-thread or parallel processing. The memory 406 may include any appropriate memory modules, such as read-only memory (ROM), random access memory (RAM), flash memory modules, and erasable and rewritable memory, and other storage media such as CD-ROM, U-disk, and hard disk, etc. The memory 406 may store computer programs for implementing various processes, such as calculating the difference value of gray scale value of adjacent pixels; and restoring the actual gray scale value of the pixels, etc., when executed by the controller 402.

Peripherals 408 may include any interface devices for providing various signal interfaces, such as USB, HDMI, VGA, DVI, etc. Further, peripherals 408 may include any input and output (I/O) devices, such as keyboard, mouse, and/or remote controller devices. Peripherals 408 may also include any appropriate communication module for establishing connections through wired or wireless communication networks.

The driver circuitry 404 may include any appropriate driving circuits, such as the disclosed display panel drive apparatus, etc., to drive the display panel 410. The display panel 410 may include any appropriate flat panel display, such as an LCD panel, an LED-LCD panel, a plasma panel, an OLED panel, etc. During operation, the display 410 may be provided with image signals by the controller 402 and the driver circuit 404 for display. Because the display apparatus includes the disclosed data transmission apparatus, and the display panel driving apparatus, the power consumption of the display apparatus may be reduced.

By using the disclosed methods and structures, the difference value of the gray scale value of adjacent pixels is used to substitute the actual gray scale value of each pixel. The data size of the data transmission and the number of binary bits occupied by the data transmission may be reduced. Thus, the electrical current consumption during the data transmission process may be reduced; and the power consumption may be lowered.

The above detailed descriptions only illustrate certain exemplary embodiments of the present invention, and are not intended to limit the scope of the present invention. Those skilled in the art can understand the specification as whole and technical features in the various embodiments can be combined into other embodiments understandable to those persons of ordinary skill in the art. Any equivalent or modification thereof, without departing from the spirit and principle of the present invention, falls within the true scope of the present invention.

What is claimed is:

1. A display data transmission method for transmitting display data to a display panel having a plurality of pixels, comprising:

calculating transmission data comprising an initial value and a plurality of sequential values, each value corresponding to a pixel of the plurality of pixels of the display panel; each of the sequential values being a difference value between a gray scale value of the corresponding pixel and a gray scale value of an adjacent previous pixel; and transmitting the transmission data to the display panel, wherein the transmission data is represented by binary numbers, and the display data transmission method, before transmitting the obtained transmission data of each pixel to the display panel, further includes:

compressing a number of binary digits occupied by the transmission data according to a size of the transmission data.

2. The display data transmission method according to claim 1, wherein the initial value corresponds to a difference value between a gray scale value of a first pixel of the display panel and a pre-set gray scale value.

3. The display data transmission method according to claim 2, wherein:

the pre-set gray scale value is a medium value of all gray scale values of the display panel;

the gray scale of the display panel includes 256 gray scale values from 0 to 255; and the pre-set gray scale value is 128.

4. The display data transmission method according to claim 2, wherein:

each pixel includes three subpixels; and the three subpixels are a red subpixel, a green subpixel and a blue subpixel.

5. The display data transmission method according to claim 4, wherein the difference value between the gray scale value and the pre-set gray scale value of the first pixel is calculated by:

calculating a difference value between a gray scale value of the red subpixel of the first pixel and a pre-set gray scale value to be used as transmission data of the red subpixel of the first pixel;

calculating a difference value between a gray scale value of the green subpixel of the first pixel and a pre-set gray scale value to be used as transmission data of the green subpixel of the first pixel; and calculating a difference value between a gray scale value of the blue subpixel of the first pixel and a pre-set gray scale value to be used as transmission data of the blue subpixel of the first pixel.

6. The display data transmission method according to claim 4, wherein the difference value between the gray scale value of the corresponding pixel and the gray scale value of an adjacent previous pixel is calculated by:

calculating a difference value between a gray scale value of the red subpixel of the corresponding pixel and a gray scale value of the red subpixel of an adjacent previous pixel to be used as transmission data of the red subpixel of the corresponding pixel;

calculating a difference value between a gray scale value of the green subpixel of the corresponding pixel and a gray scale value of the green subpixel of an adjacent previous pixel to be used as transmission data of the green subpixel of the corresponding pixel; and calculating a difference value between a gray scale value of the blue subpixel of the corresponding pixel and a gray scale value of the blue subpixel of an adjacent previous pixel to be used as transmission data of the blue subpixel of the corresponding pixel.

7. A display panel drive method, comprising:

the display data transmission method according to claim 1; and a display data restore method.

8. The display panel drive method according to claim 7, the display data restore method further includes:

adding the initial value with the pre-set gray scale value to obtain a restored gray scale value of the first pixel;

adding each of the sequential values of the corresponding pixel to a gray scale value of an adjacent previous pixel to obtain a restored gray scale value of corresponding pixel; and driving the display panel to display the pixels according to the restored gray scale values.

9. A display data transmission method for transmitting display data to a display panel having a plurality of pixels, comprising:

calculating transmission data comprising an initial value and a plurality of sequential values, each value corresponding to a pixel of the plurality of pixels of the display panel; each of the sequential values being a difference value between a gray scale value of the corresponding pixel and a gray scale value of an adjacent previous pixel; and transmitting the transmission data to the display panel, wherein:

each pixel includes three subpixels;

the binary bits occupied by the transmission data of each subpixel include a direction flag; and the direction flag is disposed at the first bit of the transmission data.

10. The display data transmission method according to claim 9, wherein, for each subpixel of the first pixel:

when a gray value is greater than or equal to a pre-set gray scale value, the direction flag is set as 1; and when the gray value is smaller than a pre-set gray scale value, the direction flag is set as 0.

11. The display data transmission method according to claim 9, wherein, for each subpixel of the pixels staring from the second pixel to the last pixel of the display panel:

when a gray value is greater than or equal to a gray scale value of the corresponding subpixel of an adjacent previous pixel, the direction flag is set as 1; and when the gray value is smaller than a gray scale value of the corresponding subpixel of an adjacent previous pixel, the direction flag is set as 0.

12. The display data transmission method according to claim 9, wherein:

the transmission data of each pixel includes transmission data of the three subpixels and a length flag used to label number of binary bits occupied by each subpixel; and the length flag is disposed as the first bit of the transmission data.

13. The display data transmission method according to claim 12, wherein:

when the number of the binary bits occupied by the transmission data of each subpixel is 8, the length flag is set as 1; and when the number of the binary bits occupied by the transmission data of each subpixel is greater than 2 and smaller than 8, the length flag is set as 0.

14. A display data transmission apparatus configured to transmit display data to a display panel, comprising:

a calculating unit configured to calculate transmission data comprising an initial value and a plurality of sequential values, each value corresponding to a pixel of the plurality of pixels of the display panel; each of the sequential values being a difference value between a gray scale value of the corresponding pixel and a gray scale value of an adjacent previous pixel; and a transmission unit configured to transmit the transmission data of each pixel obtained by the calculating unit to the display panel, and a data processing unit configured to compress a number of binary bits occupied by the transmission data according to a size of the transmission data, and to transmit the compressed data to the transmission unit.

15. A display panel drive apparatus, comprising:

the display data transmission apparatus according to claim 14; and a display data restore apparatus configured to restore transmission data of each pixel to a restored gray scale value.

16. The display panel drive apparatus according to claim 15, wherein the display data restore apparatus further includes:

a data restore unit configured to add the initial value with the pre-set gray scale value to obtain a restored gray scale value of the first pixel and to add each of the sequential values of the corresponding pixel to a gray scale value of an adjacent previous pixel to obtain a restored gray scale value of corresponding pixel; and a display drive unit configured to drive the display panel to display the pixels according to the restored gray scale values obtained by the data restore unit.

* * * * *